US009802772B2

(12) United States Patent
Sai

(10) Patent No.: US 9,802,772 B2
(45) Date of Patent: Oct. 31, 2017

(54) LONG LENGTH SHEET LOADER AND IMAGE FORMING APPARATUS INCORPORATING THE LONG LENGTH SHEET LOADER

(71) Applicant: Kiho Sai, Tokyo (JP)

(72) Inventor: Kiho Sai, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/194,695

(22) Filed: Jun. 28, 2016

(65) Prior Publication Data

US 2017/0001815 A1 Jan. 5, 2017

(30) Foreign Application Priority Data

Jun. 30, 2015 (JP) ..... 2015-132003

(51) Int. Cl.
*B65H 1/04* (2006.01)

(52) U.S. Cl.
CPC ..... *B65H 1/04* (2013.01); *B65H 2405/11164* (2013.01); *B65H 2405/324* (2013.01); *B65H 2407/21* (2013.01)

(58) Field of Classification Search
CPC B65H 1/04; B65H 31/20; B65H 2405/11162; B65H 2405/11164; B65H 2405/111646; B65H 2407/21; B65H 2405/324
USPC ..... 271/162, 171, 223
See application file for complete search history.

(56) References Cited

U.S. PATENT DOCUMENTS

2006/0291342 A1* 12/2006 Kang ..... B65H 1/04 369/30.78
2011/0278789 A1* 11/2011 Otani ..... B65H 31/20 271/207
2013/0032989 A1* 2/2013 Okuchi ..... B65H 1/04 271/3.14
2013/0049289 A1* 2/2013 Ichikawa ..... B65H 1/04 271/121
2013/0161897 A1* 6/2013 Matsumoto ..... B65H 1/04 271/121
2013/0164064 A1* 6/2013 Matsumoto ..... B65H 1/04 399/361
2014/0319760 A1* 10/2014 Komuro ..... B65H 1/02 271/223

FOREIGN PATENT DOCUMENTS

JP 2002-167083 6/2002
JP 2003-201054 7/2003
JP 2009-057175 3/2009

* cited by examiner

*Primary Examiner* — David H Bollinger
(74) *Attorney, Agent, or Firm* — Harness, Dickey & Pierce, P.L.C.

(57) ABSTRACT

A long sheet loader, which is included in an image forming apparatus, includes an attaching device and a base loading body. The attaching device is attached to a bypass tray configured to be openable or closable relative to a side face of an apparatus body of an image forming apparatus. The base loading body is attached to the bypass tray via the attaching device and movably in a sheet feeding direction of the bypass tray. The base loading body loads a long length sheet set on the bypass tray in a case in which a length of the long length sheet exceeds a length of the bypass tray.

19 Claims, 7 Drawing Sheets

LONG LENGTH SHEET LOADER AND IMAGE FORMING APPARATUS INCORPORATING THE LONG LENGTH SHEET LOADER

CROSS-REFERENCE TO RELATED APPLICATIONS

This patent application is based on and claims priority pursuant to 35 U.S.C. §119(a) to Japanese Patent Application No. 2015-132003, filed on Jun. 30, 2015, in the Japan Patent Office, the entire disclosure of which is hereby incorporated by reference herein.

BACKGROUND

Technical Field

This disclosure relates to a long length sheet loader and an image forming apparatus incorporating the long length sheet loader.

Related Art

Various types of image forming apparatuses include copiers, printers, facsimile machines, or multifunction peripherals (MFPs) having two or more of copying, printing, scanning, facsimile transmission, plotter, and other capabilities. Such image forming apparatuses includes a sheet tray to load various types of recording media such as JIS-based various standard size recording media and post card size recording media. For loading a long length sheet having a longitudinal length two or more times greater than a lateral length, a long length sheet loading tray designated to the long length sheet is provided to such image forming apparatuses. The long length sheet loading tray is generally attached to a bypass tray that is tiltably mounted on a side face of an apparatus body of an image forming apparatus.

SUMMARY

At least one aspect of this disclosure provides a long length sheet loader including includes an attaching device and a base loading body. The attaching device is attached to a bypass tray configured to be openable or closable relative to a side face of an apparatus body of an image forming apparatus. The base loading body is attached to the bypass tray via the attaching device and movably in a sheet feeding direction of the bypass tray. The base loading body loads a long length sheet set on the bypass tray in a case in which a length of the long length sheet exceeds a length of the bypass tray.

Further, at least one aspect of this disclosure provides an image forming apparatus including an apparatus body, a bypass tray configured to be openable or closable relative to a side face of the apparatus body, and the above-described long length sheet loader attached to at least one of a sheet feeding side and a sheet ejecting side of the apparatus body.

DETAILED DESCRIPTION

Figure 1:
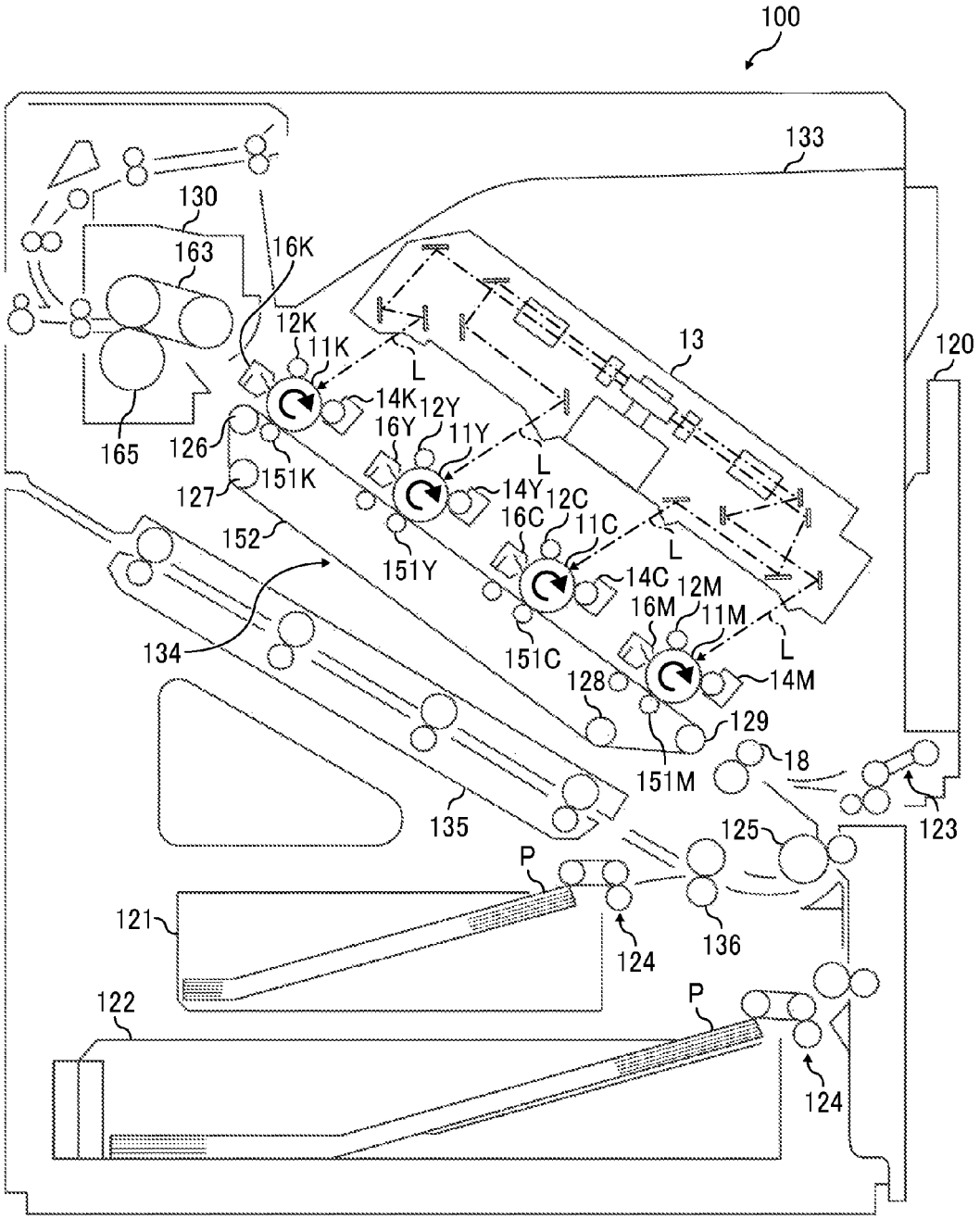
FIG. 1 is a diagram illustrating a schematic configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" mod/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a long length sheet loader and an image forming apparatus incorporating the long length sheet loader with reference to drawings.

FIG. 1 is a diagram illustrating a schematic configuration of an image forming apparatus 100 according to an embodiment of this disclosure. The image forming apparatus 100 is a tandem-type color image forming apparatus with a direct transferring system.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, ORP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

Now, the image forming apparatus 100 includes three sheet trays, which are one bypass tray 120 and two sheet trays 121 and 122. A sheet (transfer sheet) P that is fed from the bypass tray 120 is fed by a sheet feeder 123 one by one in the order from an uppermost sheet toward a pair of registration rollers 18.

The sheet (transfer sheet) P that is fed from a selected one of the sheet trays 121 and 122 is separated one by one by a sheet feeder 123 from an uppermost sheet placed on top of a bundle of sheets and conveyed toward a pair of registration rollers 18 via a pair of sheet conveying rollers 125.

The sheet P is temporarily stopped at the pair of registration rollers 18 where skew of the sheet P is corrected. Thereafter, when a registration clutch is turned on to start rotation of the pair of registration rollers 18 again, the sheet P is conveyed toward a transfer belt 152 that functions as a transfer body. This transfer of the sheet P is performed in synchronization of movement of an image formed on an extreme upstream photoconductor drum 11 so as to meet a leading end of an image formed on the extreme upstream photoconductor drum 11 that functions as an image bearer located at an extreme upstream position with a predetermined position in the sheet conveying direction of the sheet P.

Then, the sheet P is conveyed toward a sheet attraction nip region that is formed by the transfer belt 152 and a sheet attraction roller in contact with the transfer belt 152. When passing through the sheet attraction nip region, the sheet P is electrostatically attracted to the transfer belt 152 due to bias applied to the sheet attraction roller and is further conveyed at a predetermined process linear velocity.

The image forming apparatus 100 includes photoconductor drums 11M, 11C, 11Y, and 11K functioning respective image bearers, and transfer rollers 151M, 151C, 151Y, and 151K functioning respective transfer bias appliers. The transfer rollers 151M, 151C, 151Y, and 151K are disposed facing the photoconductor drums 11M, 11C, 11Y, and 11K with the transfer belt 152 interposed therebetween.

A transfer bias voltage having an opposite polarity to a toner charge polarity is applied by the transfer rollers 151M, 151C, 151Y, and 151K to the sheet P that is attracted to the transfer belt 152. By so doing, respective single color toner images formed on the photoconductor drums 11M, 11C, 11Y, and 11K are transferred onto the sheet P in the order of a magenta (M) toner image, a cyan (C) toner image, a yellow (Y) toner image, and a black (K) toner image. Consequently, a composite toner image is formed.

After the respective single toner images are transferred and overlaid onto the sheet P, the sheet P is separated from the transfer belt 152 due to curvature separation at a support roller 126 that is immediately downstream from the photoconductor drum 11K in a sheet conveying direction. Then, the sheet P is conveyed to a fixing device 130. The fixing device 130 includes a fixing belt 163 and a pressure roller 165. A fixing nip region is formed between the fixing belt 163 and the pressure roller 165. By passing through the fixing nip region in the fixing device 130, the composite toner image is fixed to the sheet P by application of heat and pressure. In a single-side printing mode, the sheet P having a fixed image thereon is ejected to a sheet ejection tray that is formed on a top face of the apparatus body.

If a duplex printing mode is selected, the sheet P that has passed through the fixing device 130 is conveyed to a sheet reversing device. After the side of the sheet P has been reversed, the sheet P is further conveyed toward a duplex printing sheet transfer device 135 that is disposed below a transfer device 134. The sheet P is fed from the duplex printing sheet transfer device 135, and conveyed again to the pair of registration rollers 18 via a pair of sheet conveying rollers 136 and the pair of sheet conveying rollers 125. Thereafter, the same fixing operation as in the single-side printing mode is performed in the fixing device 130, and eventually the sheet P is ejected to the sheet ejection tray 133.

As illustrated in FIG. 1, each photoconductor drum 11 (i.e., the photoconductor drums 11M, 11C, 11Y, and 11K) is surrounded by various image forming devices such as a charging device 12 (i.e., charging devices 12M, 12C, 12Y, and 12K), an optical writing device 13, a developing device 14 (i.e., developing devices 14M, 14C, 14Y, and 14K), and a cleaning device 16 (i.e., cleaning devices 16M, 16C, 16Y, and 16K). These image forming devices included in the image forming apparatus 100 according to the present embodiment of this disclosure are similar to each other, except that colors of toners are different. Therefore, the suffixes are omitted occasionally. The optical writing device 13 is formed in a single unit and emits laser light L to the photoconductor drums 11M, 11C, 11Y, and 11K.

The photoconductor drums 11M, 11C, 11Y, and 11K are disposed in contact with the transfer belt 152. As previously described, the transfer rollers 151M, 151C, 151Y, and 151K are disposed facing the photoconductor drums 11M, 11C, 11Y, and 11K with the transfer belt 152 interposed therebetween.

The transfer belt 152 is wound around multiple support rollers 126, 127, 128, and 129 functioning as supports. In the present embodiment, the transfer rollers 151M, 151C, 151Y, and 151K are employed as transfer bias appliers. However, the configuration of a transfer bias applier is not limited thereto. For example, any of a brush, a brush roller, and a blade can be applied to this disclosure.

Now a description is given of a comparative bypass tray attached to an image forming apparatus.

A comparative bypass tray is unfolded from an apparatus body of an image forming apparatus to open to use and is stowed in the apparatus body to close when the bypass tray is not used. However, when a user tries to stow the bypass tray in the apparatus body with a comparative long length sheet loading tray being attached to the bypass tray, the long length sheet loading tray interferes with the apparatus body, which hinders a closing movement of the bypass tray.

For this reason, the long length sheet loading tray is forced to be left open even when the long length sheet loading tray is not used. As a result, a larger area is prepared to install an image forming apparatus and, at the same time, the image forming apparatus stands in the way of people moving and working therearound.

By contrast, after the long length sheet loading tray is removed from the bypass tray, an extra space is needed for storing the long length sheet loading tray in the apparatus body. In addition, each time the long length sheet loading tray is used, a user needs to attach the long length sheet loading tray to the bypass tray, which is a cumbersome work.

Another comparative long length sheet loading tray is proposed to address this inconvenience. This comparative long length sheet loading tray is vertically rotatably supported by the bypass tray and is folded in a lower part of the bypass tray.

However, the comparative long length sheet loading tray is unfolded upwardly from the lower part of the bypass tray when opening the long length sheet loading tray. In addition, the comparative long length sheet loading tray is folded toward the lower part of the bypass tray when closing the comparative long length sheet loading tray. Therefore, the opening and closing operations of the long length sheet loading tray are troublesome.

Next, a description is given of a configuration of a long length sheet loading tray 1 provided to the image forming apparatus 100.

Figure 2:
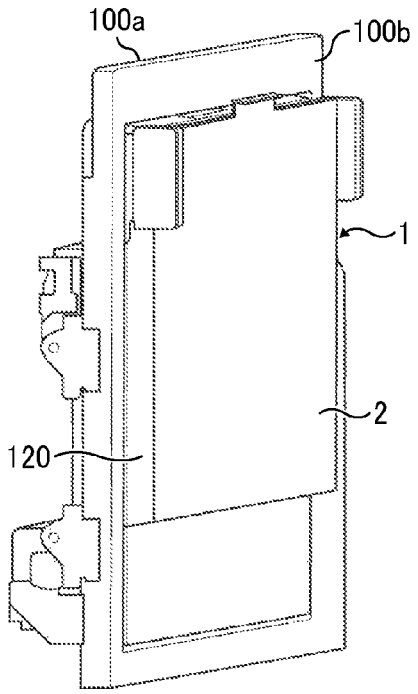
FIG. 2 is a perspective view illustrating a closed state of a bypass tray and a long length sheet loading tray according to an embodiment of this disclosure.
Figure 3:
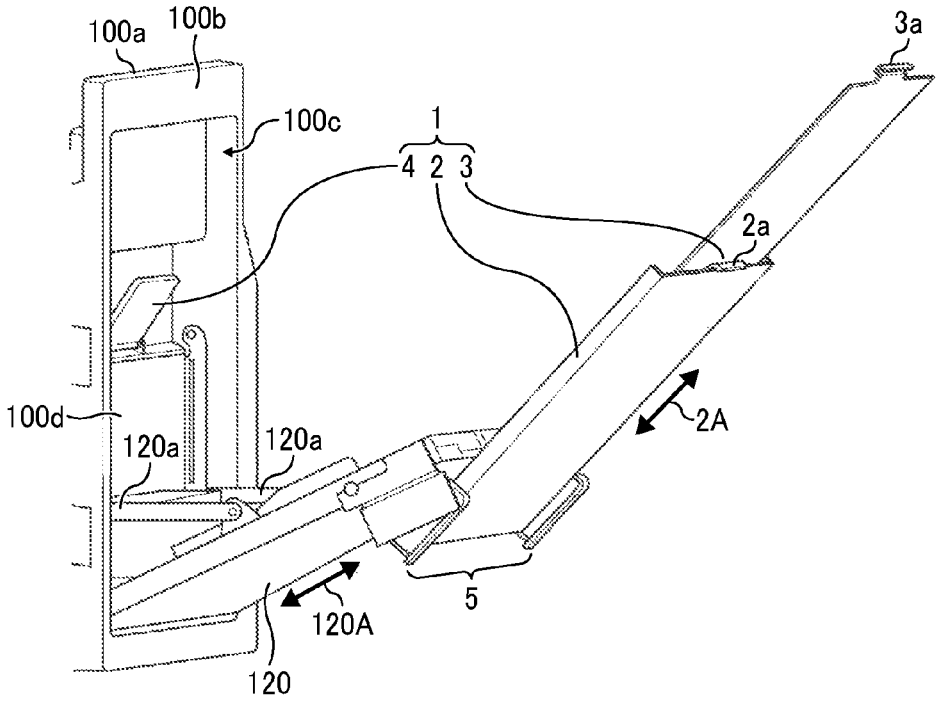
FIG. 3 is a perspective view illustrating an open state of the bypass tray and the long length sheet loading tray according to an embodiment of this disclosure.

FIG. 2 is a perspective view illustrating a closed state of the bypass tray 120 and the long length sheet loading tray 1 according to an embodiment of this disclosure. FIG. 3 is a perspective view illustrating an open state of the bypass tray 120 and the long length sheet loading tray 1 according to an embodiment of this disclosure.

As illustrated in FIGS. 2 and 3, the long length sheet loading tray 1 is used to load and place along length sheet thereon. The long length sheet has a length greater than a standard size sheet and cannot be fed while loading on the bypass tray 120. For example, the long length sheet has a longitudinal length two or more times greater than a lateral length. The long length sheet loading tray 1 includes a base loading body 2, an extendable loading body 3, and an auxiliary loading body 4. The base loading body 2 is attached to the bypass tray 120. The extendable loading body 3 is attached to the base loading body 2. The auxiliary loading body 4 is attached to an apparatus body 100*a* of the image forming apparatus 100.

Now, a description is given of the bypass tray 120 according to an embodiment of this disclosure.

The bypass tray 120 has a flat plate on which any sheet up to A3 elongation size can be loaded. The bypass tray 120 is tiltably or inclinably attached to a side face 100*b* in the sheet conveying direction of an apparatus body 100*a*. Specifically, the bypass tray 120 is openable or closable relative to the apparatus body 100*a*.

A description is given of detailed configurations of the bypass tray 120.

The apparatus body 100*a* has a side face 100*b* on a sheet feeding side. The apparatus body 100*a* further includes a containing portion 100*c* in which the bypass tray 120 is stowed. Further, a sheet feeding port 100*d* is provided at the center of the containing portion 100*c* to feed both a standard size sheet and a long length sheet therefrom.

A lower end of the bypass tray 120 is vertically rotatably attached to a lower part of the sheet feeding port 100*d* via a rotary shaft. Further, respective intermediate portions on the right and left sides of the bypass tray 120 are vertically rotatably attached to the lower part of the sheet feeding port 100*d* via support arms 120*a*.

As illustrated in FIGS. 2 and 3, the support arms 120*a* are retained at a predetermined angle of inclination when the bypass tray 120 is rotated and inclined downwardly. The predetermined angle of inclination is an angle at which a standard size sheet or a long length sheet can be fed while being loaded on the bypass tray 120.

Further, as illustrated in FIGS. 2 and 3, the bypass tray 120 is rotated and inclined upwardly to be stowed in the containing portion 100*c*.

The base loading body 2 is attached to the lower part of the bypass tray 120 at an angled position via an attaching device 5, specifically at a predetermined angle of inclination. The base loading body 2 is attached to be movable in a tray length direction 120A extending along a longitudinal length of the bypass tray 120. The tray length direction 120A is basically identical to the sheet feeding direction.

The base loading body 2 is a planar body extending in the tray length direction 120A of the bypass tray 120 so that a long length sheet is loaded on both the base loading body 2 and the bypass tray 120. The base loading body 2 has a U shape in cross section opening upwardly.

A snap 2*a* is mounted on an upper end of the base loading body 2. The snap 2*a* has an upwardly curved shape.

The extendable loading body 3 is attached to an upper part of the base loading body 2 in an angled state. The extendable loading body 3 is attached to be movable in a tray length direction 2A extending along a longitudinal length of the base loading body 2. The tray length direction 2A indicates the sheet feeding direction. The extendable loading body 3 is a planar body extending in the tray length direction 2A of the base loading body 2 so that a long length sheet is loaded on and across the extendable loading body 3, the base loading body 2, and the bypass tray 120. The extendable loading body 3 is designed to be stowed in the base loading body 2.

A snap receiver 3*a* is mounted on an upper end of the extendable loading body 3. The snap receiver 3*a* is removably fitted to the snap 2*a* of the base loading body 2 in a state in which the extendable loading body 3 is stowed in the base loading body 2. The snap receiver 3*a* has an upwardly curved shape.

The auxiliary loading body 4 is attached to the containing portion 100*c* of the side face 100*b* of the apparatus body 100*a* at an angled position to an upper side of the sheet feeding port 100*d*.

A description is given of a detailed configuration of the auxiliary loading body 4.

Figure 4:
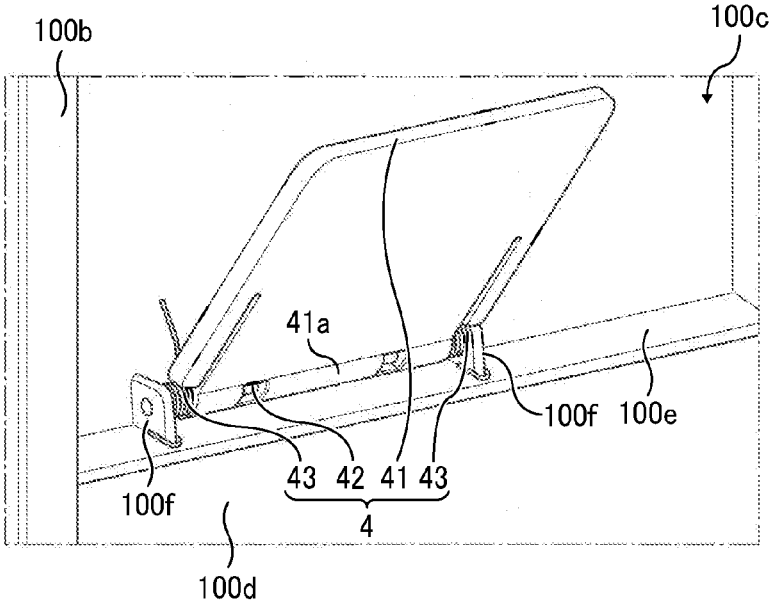
FIG. 4 is a perspective view illustrating an auxiliary loading body according to an embodiment of this disclosure.

FIG. 4 is a perspective view illustrating the auxiliary loading body 4 according to an embodiment of this disclosure.

As illustrated in FIG. 4, the auxiliary loading body 4 is mounted on an attachment edge 100*e* that is an upper edge of the sheet feeding port 100*d*. A pair of attachment pieces 100*f* is mounted on the attachment edge 100*e*. The pieces of the pair of attachment pieces 100*f* stand at separate positions to the left and right sides.

The auxiliary loading body 4 includes a rotary shaft 42, a loading body 41, and a pair of torsion springs 43. The rotary shaft 42 is rotatably attached to the pair of attachment pieces 100*f*. The loading body 41 is attached to the rotary shaft 42. Torsion springs 43 of the pair of torsion springs 43 are separately provided at both axial ends of the rotary shaft 42. Each torsion spring of the pair of torsion springs 43 functions as a biasing body to apply a biasing force to regulate a degree of rotation of the rotary shaft 42.

The loading body 41 has a planar body and is designed to load a long length sheet in a state in which the bypass tray 120 is open at the angled position and which the base loading body 2 is extended or both the base loading body 2 and the extendable loading body 3 are pulled out, as illustrated in FIG. 3.

Specifically, the loading body 41 holds the leading end of the long length sheet that is loaded on and across the bypass tray 120, the base loading body 2, and the extendable loading body 3 with the leading end of the long length sheet turned upward toward the apparatus body 100*a*. The loading body 41 includes an insertion portion 41*a* at a lower end thereof, so that the rotary shaft 42 is inserted into the insertion portion 41*a*.

The rotary shaft 42 is inserted into the insertion portion 41*a* of the loading body 41 and is rotatably attached to the pair of attachment pieces 100*f*. The rotary shaft 42 rotates the loading body 41 vertically.

The respective springs of the pair of torsion springs 43 are wound around both axial ends of the rotary shaft 42. The pair of torsion springs 43 regulates a degree of rotation of the rotary shaft 42 so as to retain the loading body 41 at a predetermined angle of inclination. The predetermined angle of inclination is an angle at which the leading end of a long length sheet can be loaded.

The attaching device 5 supports the base loading body 2 that is pulled out from the bypass tray 120 vertically rotatably with respect to the bypass tray 120 and retains the base loading body 2 at the predetermined angle of inclination with respect to the bypass tray 120. The predetermined angle of inclination is an angle at which a long length sheet can be fed while being loaded on the base loading body 2.

Figure 5:
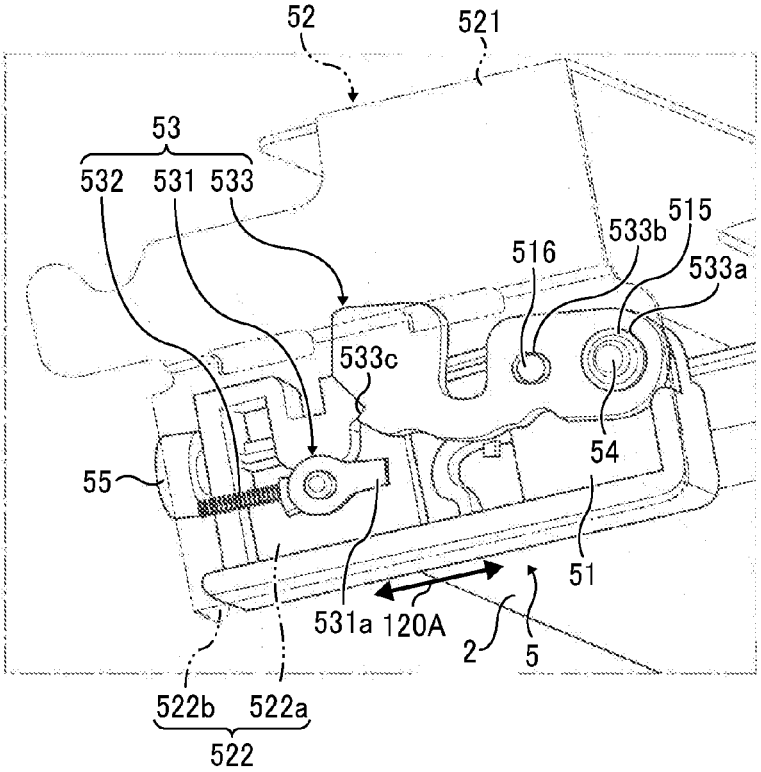
FIG. 5 is a left side view illustrating an attaching device according to an embodiment of this disclosure.

FIG. 5 is a left side view illustrating the attaching device 5 according to an embodiment of this disclosure.

The attaching device 5 includes first supports 51, a second support 52, and locking portions 53. The first supports 51 are attached to both the left and right sides of the base loading body 2. The second support 52 is attached to the bypass tray 120 (see FIG. 3). Each of the locking portions 53 links a corresponding one of the first supports 51 and a corresponding one of the second support 52.

FIG. 5 is a drawing illustrating the attaching device 5 viewed from the left side. Therefore, the first support 51 and the locking portion 53 attached to the right side of the attaching device 5 are omitted here. However, it is to be noted that the first support 51 and the locking portion 53 provided on the right side of the attaching device 5 have the same configuration as the first support 51 and the locking portion 53 provided on the left side. In FIG. 5, the second support 52 is illustrated in broken lines. Further, the bypass tray 120 is omitted in FIG. 5.

First, a description is given of a configuration of the first supports 51.

The first supports 51 support the base loading body 2 to be movable in the tray length direction 120A along the longitudinal length of the bypass tray 120. Each of the first supports 51 has a roughly square shape.

Figure 6:
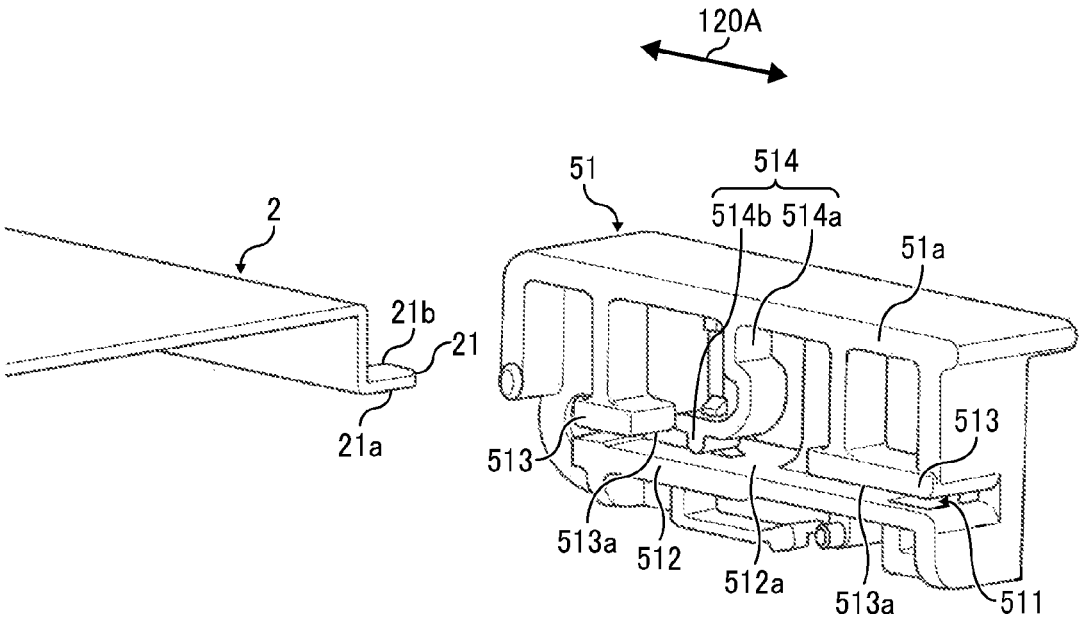
FIG. 6 is a perspective view illustrating the loading portion and a first support according to an embodiment of this disclosure.

FIG. 6 is a perspective view illustrating the base loading body 2 and the first support 51 according to an embodiment of this disclosure.

As illustrated in FIG. 6, a guide 511 is disposed on an inner side face of the first support 51. The guide 511 supports the base loading body 2 and guides movement of the base loading body 2.

It is to be noted that FIG. 6 illustrates a vertically inverted state of the first support 51 and the base loading body 2.

The guide 511 has a gutter that extends in the tray length direction 120A of the bypass tray 120. The guide 511 is designed to receive one of left and right end portions 21 of the base loading body 2, so that the one of the left and right end portions 21 slides along the gutter of the guide 511.

The guide 511 includes a guide upper body 512 on an upper side of the guide 511. It is to be noted that the guide upper body 512 is formed on a lower side of the guide 511 in FIG. 6. A bottom face 512*a* of the guide upper body 512 contacts a top face 21*a* of the end portion 21 of the base loading body 2. Front and rear end portions (both end portions in the tray length direction 120A) of the bottom face 512*a* of the guide upper body 512 are curved upwardly while the other parts of the bottom face 512*a* are not. Therefore, the bottom face 512*a* is formed to have an uneven surface.

The guide 511 further includes guide lower bodies 513 on the lower side of the guide 511. It is to be noted that the guide lower bodies 513 are formed on the upper side of the guide 511 in FIG. 6. The guide lower bodies 513 are disposed at separate positions in the tray length direction 120A. Respective top faces 513*a* of the guide lower bodies 513 contact a bottom face 21*b* of the end portion 21 of the base loading body 2.

A pressing body 514 is disposed between the guide lower bodies 513 inside the first support 51. The pressing body 514 includes a spring 514*a* and a projection 514*b*. The spring 514*a* has a bow-shaped body that is upwardly curving and extending from a bottom 51*a* of the first support 51. The projection 514*b* is provided at an upper end (a leading end) of the spring 514*a*.

Figure 7:
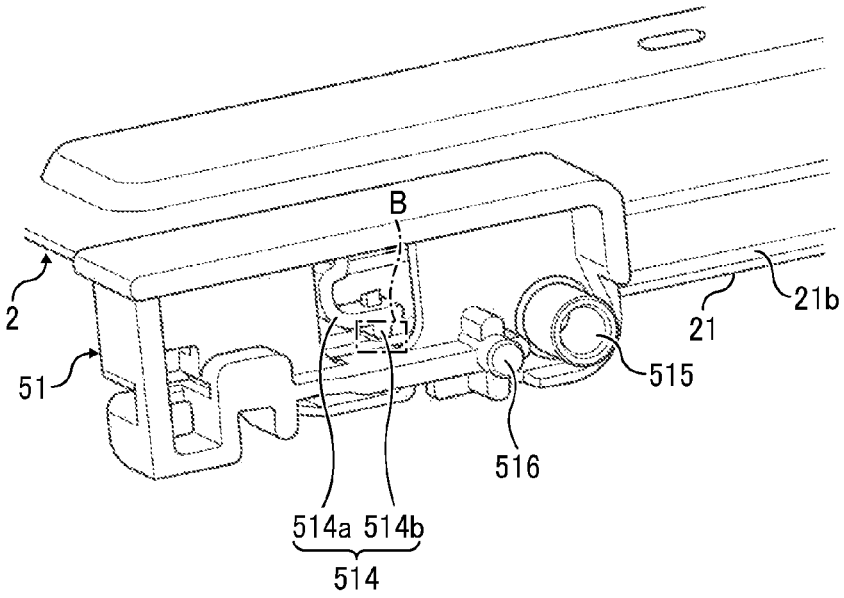
FIG. 7 is a perspective view illustrating the loading portion and the first support attached to the loading portion according to an embodiment of this disclosure.
Figure 8:
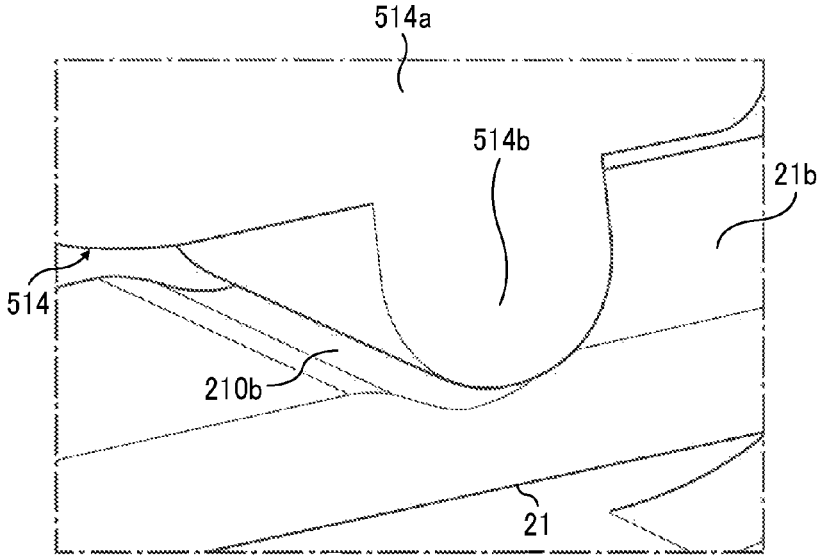
FIG. 8 is an enlarged view illustrating an area B of FIG. 7.

FIG. 7 is a perspective view illustrating the base loading body 2 and the first support 51 attached to the base loading body 2 according to an embodiment of this disclosure. FIG. 8 is an enlarged view illustrating an area B of FIG. 7.

The spring 514*a* has elasticity (resilience).

As illustrated in FIG. 7, the projection 514*b* presses the bottom face 21*b* of the end portion 21 of the base loading body 2 by applying an elastic force (a biasing force) of the spring 514*a*.

It is to be noted that FIG. 7 illustrates a vertically inverted state of the first support 51 and the base loading body 2.

As illustrated in FIG. 8, a recess 210*b* is formed at a removal limit position of the base loading body 2 on the bottom face 21*b* of the end portion 21 of the base loading body 2. The recess 210*b* receives and fits with the projection 514*b* of the pressing body 514.

It is to be noted that the removal limit position is a position up to which a long length sheet can be loaded within a range the base loading body 2 is not completely detached from the first support 51.

Further, as illustrated in FIG. 7, a boss 515 is mounted on an outer side face of the first support 51, at a front or near side (in a pull-out direction) from the pressing body 514. A rotary shaft 54 (see FIG. 5) is inserted into the boss 515. A rotary shaft 54 (see FIG. 5) is inserted into the boss 515.

Next, a description is given of a configuration of the second support 52.

As illustrated in FIG. 5, the second support 52 supports the first support 51 (the base loading body 2) to be vertically rotatable with respect to the bypass tray 120 via the rotary shaft 54 and the locking portion 53.

Figure 9:
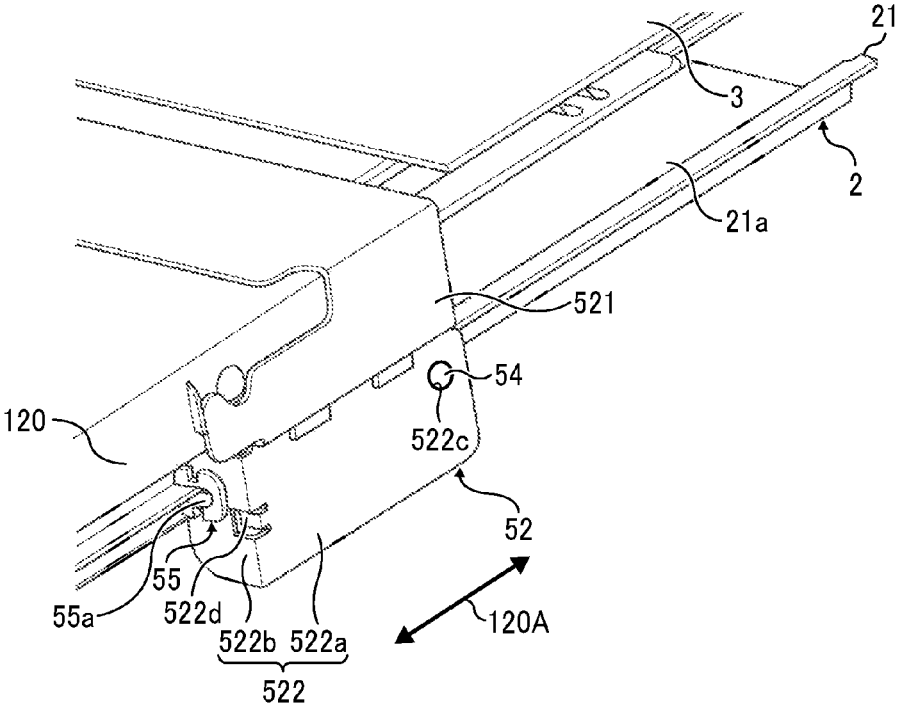
FIG. 9 is a perspective view illustrating a state of attachment of a second support according to an embodiment of this disclosure.

FIG. 9 is a perspective view illustrating a state of attachment of the second support 52 according to an embodiment of this disclosure. As illustrated in FIG. 9, the second support 52 is attached to or near a distal end (a far end) of the bypass tray 120 with respect to the apparatus body 100*a*. The second support 52 includes a second support body 521 and a pair of attachment pieces 522. The second support body 521 is attached to cover the upper face, the left side face, and the right side face of the bypass tray 120. Both pieces of the pair of attachment pieces 522 are joined to lower ends of left and right of the second support body 521. It is to be noted that FIG. 9 is a drawing illustrating the second support 52 viewed from the left side. Therefore, the attachment piece 522 attached to the right side of the second support 52 is here. However, it is to be noted that the attachment piece 522 provided on the right side of the second support 52 has the same configuration as the attachment piece 522 provided on the left side.

The second support body 521 has a planar and inversed U-shaped body.

As illustrated in FIGS. 5 and 9, the attachment piece 522 has a planar and L-shaped body to cover an outer side face and a rear face of the first support 51. The rear face of the first support 51 is a face on the insertion side in the tray length direction 120A.

To be more specific, with reference to FIGS. 5 and 9, the attachment piece 522 includes a side face 522*a* and a rear face 522*b*. The side face 522*a* of the attachment piece 522 covers the outer side face of the first support 51. The rear face 522*b* is joined to the rear end of the side face 522*a* to cover the rear face of the first support 51.

A support opening 522*c* is formed on the front side (in the pull-out direction) of the side face 522*a*. The rotary shaft 54 is secured to the support opening 522*c* is secured to the rotary shaft 54 by caulking.

A regulator 55 is mounted on the rear face 522*b* to regulate rotation of the first support 51 (the base loading body 2). The regulator 55 includes an insertion opening 55*a* to insert the end portion 21 of the base loading body 2. The insertion opening 55*a* corresponds to a setting position so as to be lead to the guide 511 of the first support 51 (see FIG. 6).

Further, the setting position of the insertion opening 55*a* is set to the rear side from a pull-out position at which a long length sheet can be loaded on the base loading body 2. That is, when the end portion 21 of the base loading body 2 is detached from the insertion opening 55*a*, the base loading body 2 does not rotate, and therefore the base loading body 2 is protected and prevented form rotating.

Next, a description is given of a configuration of the locking portions 53.

Since both of the locking portions 53 have the identical configuration and functions to each other, the locking portions 53 are described in a singular form. The locking portion 53 holds the base loading body 2 at a predetermined angle of inclination with rotation of the base loading body 2 toward an upward direction toward the apparatus body 100*a*. When the base loading body 2 is rotated upwardly exceeding the predetermined angle of inclination, the retaining state of the base loading body 2 is canceled.

As illustrated in FIG. 5, the locking portion 53 includes a locking part 531, an elastic member 532, and a locking target 533. The locking part 531 is rotatably attached to the side face 522*a* of the attachment piece 522. The locking target 533 is secured to the first support 51.

The locking part 531 is provided to the left side (the insertion side) on the inner face of the attachment piece 522. An engaging part 531*a* is projected on the right side (the insertion side) of the locking part 531.

One end of the elastic member 532 is secured to the left side of the locking part 531. The opposite end of the elastic member 532 is hooked to a hook 522*d* that is disposed near the regulator 55 (see FIG. 9). The elastic member 532 stretches the locking part 531 toward the regulator 55 to maintain the position and statue of the locking part 531, that is, to prevent the locking part 531 from rotating accidentally.

The locking target 533 is a long planar body extending in a longitudinal direction of the first support 51 (corresponding to a longitudinal direction of the bypass tray 120). The locking target 533 is secured to an outer side face of the first support 51.

To be more specific, a boss securing opening 533*a* is formed on the right side of the locking target 533. The boss 515 of the first support 51 is fitted to the boss securing opening 533*a*.

A fitting portion securing opening 533*b* is formed on the left side from the boss securing opening 533*a* in the locking target 533. The fitting portion 516 of the first support 51 is fitted to the fitting portion securing opening 533*b*.

The locking target 533 is secured to the first support 51. According to this configuration, the locking target 533 moves along with rotation of the first support 51.

As previously described, the rotary shaft 54 is inserted and fitted into the boss 515 and is secured to the support opening 522*c* of the attachment piece 522 (see FIG. 9). Therefore, the locking target 533 is rotatably supported to the attachment piece 522 via the rotary shaft 54 while being secured to the first support 51. Further, according to this configuration, the first supports 51 and the base loading body 2 are rotatably supported by the second support 52 and the bypass tray 120 via the rotary shaft 54.

An engaging target 533*c* is formed on the left side of the locking target 533, so that the engaging part 531*a* of the locking part 531 is engaged to the engaging target 533*c*. The engaging target 533*c* has an inverted L shape to be engaged on the upper face of the engaging part 531*a*.

Figure 10A:
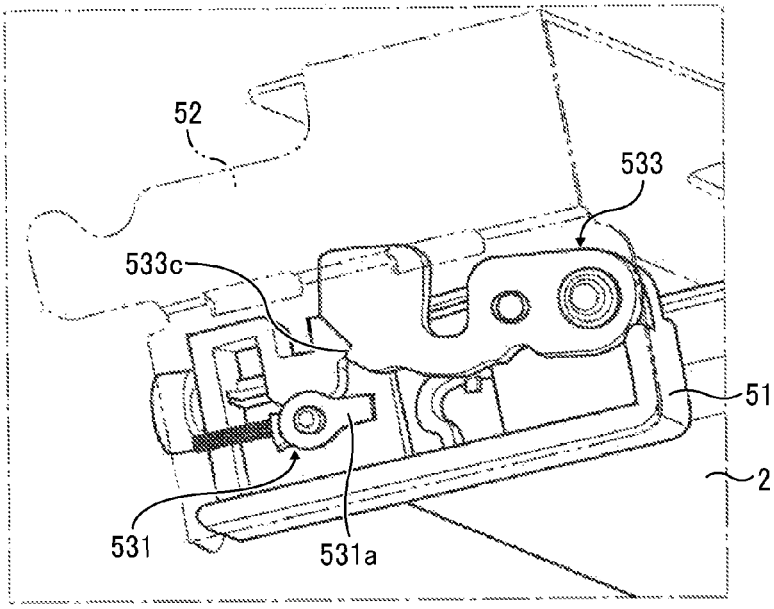
FIGS. 10A, 10B, and 10C are diagrams illustrating a series of movements of an engaging part according to an embodiment of this disclosure.
Figure 10B:
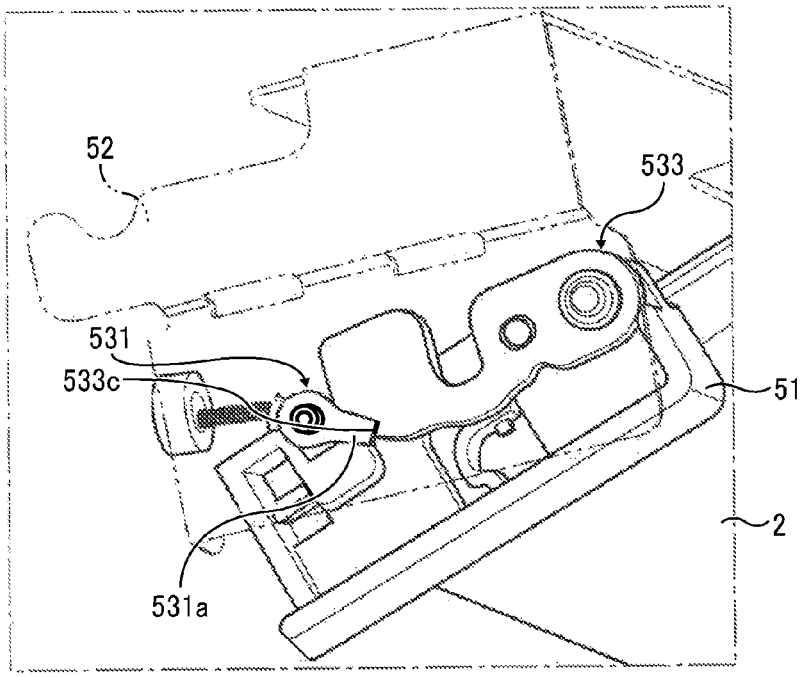
Figure 10C:
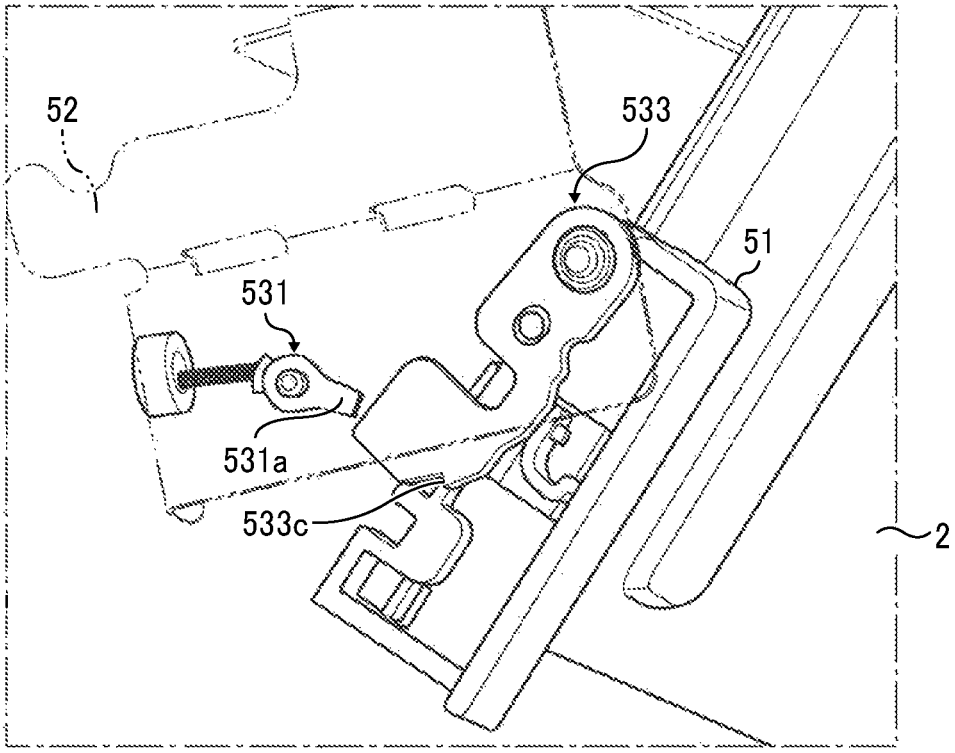

Next, a description is given of detailed operations of engaging the engaging target 533*c* with the engaging part 531*a* with reference to FIGS. 10A, 10B, and 10C. FIGS. 10A, 10B, and 10C are diagrams illustrating a series of movements of the engaging part 531*a* according to an embodiment of this disclosure.

As illustrated in FIGS. 10A and 10B, as the base loading body 2 rotates upwardly from a horizontal state with respect to the second support 52 (the bypass tray 120), the first supports 51 and the locking target 533 also move upwardly.

As illustrated in FIG. 10B, when the base loading body 2 comes to the angled position inclined at the predetermined angle of inclination, the engaging target 533*c* of the locking target 533 is engaged with the upper face of the engaging part 531*a* of the locking part 531. Accordingly, the base loading body 2 is held in the angled state at the predetermined angle of inclination.

As illustrated in FIGS. 10B and 10C, when the base loading body 2 rotates further upwardly to have an angle smaller than the predetermined angle of inclination, the engaging target 533*c* comes off from the engaging part 531*a*. Accordingly, the base loading body 2 is disengaged and released from being held at the angled state at the predetermined angle of inclination.

Next, a description is given of an opening operation and a closing operation of the long length sheet loading tray 1 provided to the image forming apparatus 100.

Opening Operation.

(1) As illustrated in FIGS. 2 and 3, the bypass tray 120 is rotated and inclined downwardly.

(2) With the base loading body 2 supported by the attaching device 5, the bypass tray 120 is pulled out to fit the projection 514*b* of the pressing body 514 to the recess 210*b*, as illustrated in FIG. 8. At this time, the base loading body 2 is detached from the regulator 55 (see FIG. 9). According to this action, the base loading body 2 can rotate together with the first supports 51.

(3) As illustrated in FIGS. 10A and 10B, the base loading body 2 is rotated and inclined upwardly. As illustrated in FIG. 10B, when the base loading body 2 comes to the angled position inclined at the predetermined angle of inclination, the locking target 533 is engaged to the locking part 531. Consequently, the base loading body 2 is held in the inclined state at the predetermined angle of inclination. According to this action, the base loading body 2 comes to an open state.

(4) Then, as illustrated in FIG. 3, the extendable loading body 3 is pulled out from the base loading body 2 to the removal limit position. The auxiliary loading body 4 becomes exposed and open when the bypass tray 120 is opened.

Closing Operation.

(1) The extendable loading body 3 is shifted toward a closing direction (in a lower side of the tray length direction 2A of the base loading body 2 in FIG. 3) to stow in the base loading body 2, so that the snap receiver 3*a* is engaged with the snap 2*a* of the base loading body 2.

(2) As illustrated in FIGS. 10B and 10C, the base loading body 2 is rotated upwardly to have the angle of inclination smaller than the predetermined angle of inclination. According to this action, the locking target 533 comes off from the locking part 531, so that the base loading body 2 is released from being held at the inclined state at the predetermined angle of inclination.

(3) Then, the base loading body 2 is rotated downwardly, so that the first supports 51 contact the bypass tray 120. In this state, the base loading body 2 is shifted to the closing direction (in the lower side of the tray length direction 120A of the bypass tray 120 in FIG. 3) to stow the base loading body 2 and the extendable loading body 3 in the lower portion of the bypass tray 120.

(4) Then, the bypass tray 120 is rotated upwardly as illustrated in the order of FIG. 3 to FIG. 2, so that the bypass tray 120 is stowed in the containing portion 100*c*. According to this action, the auxiliary loading body 4 is covered by the bypass tray 120 to come to a closed state.

Next, a description is given of effects of the long length sheet loading tray 1 according to the present embodiment of this disclosure.

The long length sheet loading tray 1 according to the present embodiment of this disclosure includes the attaching device and the base loading body 2. The attaching device 5 is attached to the bypass tray 120 to be openable or closable relative to the side face 100*b* of the apparatus body 100*a* of the image forming apparatus 100. The base loading body 2 is attached to the bypass tray 120 via the attaching device 5 movably in a tray length direction of the bypass tray 120. The base loading body 2 loads the long length sheet set on the bypass tray 120 in a case in which a length of the long length sheet exceeds a longitudinal length of the bypass tray 120.

As described in the embodiment above, the base loading body 2 can be moved in the tray length direction 120A of the bypass tray 120, and therefore can be opened and closed. Accordingly, a user does not have to unfold and move the base loading body 2 upward from the lower side of the bypass tray 120 and to fold the base loading body 2 downwardly to the lower side of the bypass tray 120. Consequently, the long length sheet loading tray 1 according to the present embodiment of this disclosure can be opened and closed easily.

Further, in the long length sheet loading tray 1 according to the present embodiment of this disclosure, when the base loading body 2 is pulled out from the bypass tray 120, the attaching device 5 supports the base loading body 2 vertically rotatably with respect to the bypass tray 120 and retains the base loading body 2 at the predetermined angle of inclination.

As described in the embodiment above, the long length sheet is loaded on the base loading body 2 with the leading end directing upwardly, and therefore the long length sheet is prevented from being hung down from the bypass tray 120. Consequently, the long length sheet loading tray 1 according to the present embodiment of this disclosure can load a long length sheet stably.

Further, the long length sheet loading tray 1 according to the present embodiment of this disclosure further includes the extendable loading body 3 that is attached to the base loading body 2 movably in the tray length direction 2A of the base loading body 2 to load the long length sheet on and across the bypass tray 120 and the base loading body 2.

As described in the embodiment above, the extendable loading body 3 can load the long length sheet when the long length sheet has a length longer than the longitudinal length of the base loading body 2 and the base loading body 2 cannot hold the long length sheet without assistance of the extendable loading body 3. Consequently, the long length sheet loading tray 1 according to the present embodiment of this disclosure can load various types of long length sheets having different sizes stably.

Further, the long length sheet loading tray 1 according to the present embodiment of this disclosure further includes the regulator 55. The regulator 55 is disposed to a closing side from a pull-out position at which the base loading body 2 can load the long length sheet at the attaching device 5 to regulate rotation of the base loading body 2.

As described in the embodiment above, the base loading body 2 can rotate reliably at the pull-out position where the long length sheet can be loaded. Consequently, the long length sheet is loaded on the base loading body 2 with the leading end directing upwardly, and therefore the long length sheet is prevented from being hung down from the bypass tray 120. Accordingly, the long length sheet loading tray 1 according to the present embodiment of this disclosure can load the long length sheet more stably.

Further, in the long length sheet loading tray 1 according to the present embodiment of this disclosure, the attaching device 5 includes the guide 511 to support the base loading body 2 and guide movement of the base loading body 2.

As described in the embodiment above, when the base loading body 2 is opened or closed, the base loading body 2 can be moved in the tray length direction 120A of the bypass tray 120 smoothly. Accordingly, the long length sheet loading tray 1 according to the present embodiment of this disclosure can be opened and closed more easily.

Further, in the long length sheet loading tray 1 according to the present embodiment of this disclosure, the attaching device 5 further includes the pressing body 514 to press the bottom face 21*b* of the end portion 21 of the base loading body 2 with elasticity against the guide 511. The bottom face 21*b* of the end portion 21 of the base loading body 2 functions as a contact face with the guide 511 of the attaching device 5.

As described in the embodiment above, the base loading body 2 moves with the bottom face 21*b* being pressed by the pressing body 514, and therefore is prevented from being swung, and can move smoothly. Accordingly, the long length sheet loading tray 1 according to the present embodiment of this disclosure can be opened and closed more easily.

Further, the long length sheet loading tray 1 according to the present embodiment of this disclosure further includes the recess 210*b* that is formed at a pull-out limit position of the base loading body 2 on the bottom face 21*b* of the base loading body 2. The recess 210*b* fits the pressing body 514 thereto.

As described in the embodiment above, a user can be aware of that the base loading body 2 is pulled out to the pull-out limit position easily. Accordingly, the long length sheet loading tray 1 according to the present embodiment of this disclosure can enhance the operability.

Further, in the long length sheet loading tray 1 according to the present embodiment of this disclosure, the guide 511 is designed such that the base loading body 2 slides on the guide 511.

As described in the embodiment above, when the base loading body 2 is opened or closed, the base loading body 2 can be moved more smoothly. Accordingly, the long length sheet loading tray 1 according to the present embodiment of this disclosure can be opened and closed more easily.

Further, in the long length sheet loading tray 1 according to the present embodiment of this disclosure, the bottom face 512*a* has an uneven surface and functions as a guide-side contact face on which the base loading body 2 slides in the guide 511.

As described in the embodiment above, when compared with a configuration in which the bottom face 512*a* has a flat and even surface, the accuracy of the bottom face 512*a* can be secured easily, and therefore a reduction in manufacturing cost can be achieved. Accordingly, the long length sheet loading tray 1 according to the present embodiment of this disclosure can be opened and closed easily with an effect of cost reduction.

Further, in the long length sheet loading tray 1 according to the present embodiment of this disclosure, the attaching device 5 includes the locking portion 53 to hold the base loading body 2 in the angled state in which the base loading body 2 comes to a position at the predetermined angle of inclination when the base loading body 2 rotates upwardly from a horizontal state with respect to the bypass tray 120.

Consequently, when the base loading body 2 is opened or closed, the base loading body 2 can be changed to the angled state easily. Accordingly, the long length sheet loading tray 1 according to the present embodiment of this disclosure can be opened and closed more easily.

Further, in the long length sheet loading tray 1 according to the present embodiment of this disclosure, when the base loading body 2 rotates upwardly at an angle smaller than the predetermined angle of inclination, the base loading body 2 is disengaged and released from the angled state.

Consequently, when the base loading body 2 is opened or closed, the retention of the base loading body 2 in the angled state can be canceled easily. Accordingly, the long length sheet loading tray 1 according to the present embodiment of this disclosure can be opened and closed more easily.

Further, the long length sheet loading tray 1 according to the present embodiment of this disclosure further includes the auxiliary loading body 4 that is attached to the apparatus body 100*a* of the image forming apparatus 100. The auxiliary loading body 4 holds the leading end of the long length sheet loaded on and across the bypass tray 120, the base loading body 2, and the extendable loading body 3 in a state in which the leading end of the long length sheet is turned upward toward the apparatus body 100*a*.

As described in the embodiment above, the auxiliary loading body 4 can load the long length sheet when the long length sheet has a length longer than the total longitudinal length of the base loading body 2 and the extendable loading body 3 and the base loading body 2 and the extendable loading body 3 cannot hold the long length sheet without assistance of the auxiliary loading body 4. Consequently, the long length sheet loading tray 1 according to the present embodiment of this disclosure can load various types of long length sheets having different sizes stably.

Further, in the long length sheet loading tray 1 according to the present embodiment of this disclosure, the auxiliary loading body 4 includes a torsion spring to retain the loading body 41 at the predetermined angle of inclination with the biasing force or resilience.

As described in the embodiment above, the leading end of the long length sheet can be loaded stably on the bypass tray 120 without applying an unnecessary force to the loading body 41. Consequently, the long length sheet loading tray 1 according to the present embodiment of this disclosure can load a long length sheet more stably.

Further, the image forming apparatus 100 according to the present embodiment of this disclosure includes the above-described long length sheet loading tray 1, so that the long length sheet loading tray 1 can be opened and closed easily. Accordingly, the convenience of the image forming apparatus 100 can be enhanced.

Further, the image forming apparatus 100 according to the present embodiment of this disclosure includes the above-described long length sheet loading tray 1, so that the long length sheet loading tray 1 can be opened and closed easily. Accordingly, the convenience of the image forming apparatus 100 can be enhanced.

Alternatively, the long length sheet loading tray 1 may be provided to both the sheet feeding side and the sheet ejecting side.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet loader comprising:

an attaching device, attachable to a bypass tray of an image forming apparatus, configured to be openable or closable relative to a side face of an apparatus body of the image forming apparatus; and a base loading body, attached to the bypass tray via the attaching device, configured to be movable in a sheet feeding direction of the bypass tray, the base loading body being configured to load a sheet set on the bypass tray in a case in which a length of the sheet exceeds a length of the bypass tray, wherein, upon the base loading body being pulled out from the bypass tray, the attaching device is configured to support the base loading body with respect to the bypass tray, and wherein the attaching device includes a locking portion to hold the base loading body in an angled state, in which the base loading body is configured to be in an open position at an angle of inclination upon the base loading body rotating toward the apparatus body from a horizontal state with respect to the bypass tray.

2. The sheet loader of claim 1, further comprising an extendable loading body, movably attached to the base loading body in the sheet feeding direction of the base loading body, to load the sheet across the bypass tray and the base loading body in a case in which the length of the sheet exceeds a sum of a length of the bypass tray and a length of the base loading body.

3. The sheet loader of claim 1, further comprising a regulator, disposed to a closing side from a pull-out position at which the base loading body is configured to load the sheet at the attaching device, to regulate rotation of the base loading body.

4. The sheet loader of claim 1, wherein, upon the base loading body rotating toward the apparatus body to an angle relatively smaller than the angle of inclination, the base loading body is configured to be disengaged from the angled state.

5. The sheet loader of claim 1, wherein the attaching device includes a guide to support the base loading body and guide movement of the base loading body.

6. The sheet loader of claim 5, wherein the guide is configured such that the base loading body is configured to slide on the guide.

7. An image forming apparatus comprising:

the apparatus body;

the bypass tray, configured to be openable or closable relative to a side face of the apparatus body; and the sheet loader of claim 1, attached to at least one of a sheet feeding side and a sheet ejecting side of the apparatus body.

8. The image forming apparatus of claim 7, wherein, upon the base loading body being pulled out from the bypass tray, the attaching device is configured to support the base loading body vertically rotatably with respect to the bypass tray and is configured to retain the base loading body at an angle.

9. The image forming apparatus of claim 8, further comprising an extendable loading body, movably attached to the base loading body in the sheet feeding direction of the base loading body, to load the sheet on and across the bypass tray and the base loading body in a case in which the length of the sheet exceeds a total longitudinal length of the bypass tray and the base loading body.

10. The image forming apparatus of claim 9, further comprising a regulator, disposed to a closing side from a pull-out position at which the base loading body loads the sheet at the attaching device, to regulate rotation of the base loading body.

11. A sheet loader comprising:

an attaching device, attachable to a bypass tray of an image forming apparatus, configured to be openable or closable relative to a side face of an apparatus body of the image forming apparatus; and a base loading body, attached to the bypass tray via the attaching device, configured to be movable in a sheet feeding direction of the bypass tray, the base loading body being configured to load a sheet set on the bypass tray in a case in which a length of the sheet exceeds a length of the bypass tray;

an extendable loading body, movably attached to the base loading body in the sheet feeding direction of the base loading body, to load the sheet across the bypass tray and the base loading body in a case in which the length of the sheet exceeds a sum of a length of the bypass tray and a length of the base loading body; and an auxiliary loading body, attached to the apparatus body of the image forming apparatus, to hold a leading end of the sheet loaded across the bypass tray, the base loading body, and the extendable loading body with the leading end of the sheet turned upward toward the apparatus body.

12. The sheet loader of claim 11, wherein the auxiliary loading body includes a loading body and a biasing body to retain the loading body at an angle with a biasing force.

13. The sheet loader of claim 11, further comprising a regulator, disposed to a closing side from a pull-out position at which the base loading body loads the sheet at the attaching device, to regulate rotation of the base loading body.

14. An image forming apparatus comprising:

the apparatus body;

the bypass tray, configured to be openable or closable relative to a side face of the apparatus body; and the sheet loader of claim 11, attached to at least one of a sheet feeding side and a sheet ejecting side of the apparatus body.

15. A sheet loader comprising:

an attaching device, attachable to a bypass tray of an image forming apparatus, configured to be openable or closable relative to a side face of an apparatus body of the image forming apparatus; and a base loading body, attached to the bypass tray via the attaching device, configured to be movable in a sheet feeding direction of the bypass tray, the base loading body being configured to load a sheet set on the bypass tray in a case in which a length of the sheet exceeds a length of the bypass tray, wherein the attaching device includes a guide to support the base loading body and guide movement of the base loading body and wherein the attaching device further includes a pressing body, configured to press a contact face of the base loading body with an elastic force against the guide.

16. The sheet loader of claim 15, wherein the guide is configured such that the base loading body is configured to slide on the guide, wherein the guide includes a contact face to slidably contact the contact face of the base loading body, and wherein the contact face of the guide has an uneven surface.

17. The sheet loader of claim 15, further comprising a recess, formed at a pull-out limit position of the base loading body on the contact face of the base loading body, to fit the pressing body.

18. The sheet loader of claim 15, wherein the guide is configured such that the base loading body is configured to slide on the guide.

19. An image forming apparatus comprising:

the apparatus body;

the bypass tray, configured to be openable or closable relative to a side face of the apparatus body; and the sheet loader of claim 15, attached to at least one of a sheet feeding side and a sheet ejecting side of the apparatus body.

* * * * *